US011128067B2

(12) United States Patent
Saeed et al.

(10) Patent No.: US 11,128,067 B2
(45) Date of Patent: Sep. 21, 2021

(54) ELECTRICAL CONNECTOR WITH ADJUSTABLE ALIGNMENT MEMBER

(71) Applicant: Hubbell Incorporated, Shelton, CT (US)

(72) Inventors: Dana Khalid Saeed, Somerville, MA (US); Jefferson Robert Hall, Concord, NH (US); Daniel Paul Owens, Brookline, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/671,569

(22) Filed: Nov. 1, 2019

(65) Prior Publication Data

US 2020/0144743 A1 May 7, 2020

Related U.S. Application Data

(60) Provisional application No. 62/754,271, filed on Nov. 1, 2018.

(51) Int. Cl.
*H01R 11/03* (2006.01)
*H01R 4/60* (2006.01)

(52) U.S. Cl.
CPC ..... *H01R 11/03* (2013.01); *H01R 4/60* (2013.01)

(58) Field of Classification Search
CPC ..... H01R 13/631; H01R 13/4367; H01R 13/4368; H01R 4/308; H01R 4/60; H01R 11/03
USPC ..... 439/380, 381, 784, 752
See application file for complete search history.

(56) References Cited

U.S. PATENT DOCUMENTS 1,646,660 A * 10/1927 Prince ..... H01R 4/5025 439/805
1,751,572 A * 3/1930 Beemer ..... H01R 4/5025 439/784
1,941,715 A * 1/1934 Pfisterer ..... H01R 4/5025 439/784
2,001,131 A * 5/1935 Guhl ..... H01R 4/5025 174/91
2,064,440 A * 12/1936 Meeker ..... H01R 4/5025 439/805
2,261,414 A * 11/1941 Rogoff ..... H01R 4/5025 439/784
2,454,829 A 11/1948 Neijstrom
3,059,208 A * 10/1962 Concelman ..... H01R 13/64 439/381

(Continued)

FOREIGN PATENT DOCUMENTS

EP 189846 8/1986
KR 10110393 1/2012

OTHER PUBLICATIONS

PCT/US2019/059377 International Search Report and Written Opinion dated Jan. 24, 2020 (9 pages).

*Primary Examiner* — Gary F Paumen
(74) *Attorney, Agent, or Firm* — Michael Best & Friedrich LLP

(57) ABSTRACT

An alignment member is provided for an electrical connector that provides electrical communication between a plurality of electrical conductors. The alignment member includes a first portion adapted to engage an opening of the connector block; a passageway for receiving one of the electrical conductors; and a second portion that is movable to adjust a dimension of the passageway.

18 Claims, 5 Drawing Sheets

(56) References Cited

U.S. PATENT DOCUMENTS

| | | | | |
|---|---|---|---|---|
| 3,165,369 | A * | 1/1965 | Maston | H01R 13/424 439/380 |
| 4,620,757 | A * | 11/1986 | Thevenaz | H01R 13/187 439/381 |
| 4,998,892 | A * | 3/1991 | Shiley | H01R 13/631 439/381 |
| 7,467,979 | B2 * | 12/2008 | Colescott | H01R 4/5091 439/784 |
| 8,500,497 | B1 * | 8/2013 | Patten | H01R 11/09 439/784 |
| 8,628,362 | B2 * | 1/2014 | Maki | H01R 13/639 439/347 |
| 2014/0273584 | A1 | 9/2014 | Sun et al. | |

* cited by examiner

ELECTRICAL CONNECTOR WITH ADJUSTABLE ALIGNMENT MEMBER

CROSS-REFERENCE TO RELATED APPLICATION

This application claims the benefit of prior-filed U.S. Provisional Patent Application No. 62/754,271, filed Nov. 1, 2018, the entire contents of which are incorporated by reference.

BACKGROUND

The present disclosure relates to a connector for coupling and electrically connecting multiple electrical conductors, and more particularly to an alignment member positioned within a connector block for maintaining electrical contact with at least one electrical conductor.

SUMMARY

In one independent aspect, an alignment member is provided for an electrical connector. The electrical connector is configured to provide electrical communication between a plurality of electrical conductors. The alignment member includes a first portion adapted to engage an opening of the connector block; a passageway configured to receive one of the electrical conductors; and a second portion coupled to the first portion, the second portion being movable to adjust a dimension of the passageway.

In some aspects, the first portion includes a threaded outer surface configured to threadably engage the opening of the connector block, threading the first portion into the opening of the connector block causing the second portion to move.

In some aspects, the first portion is an annular portion having an end surface, wherein the second portion includes a guide member supported on the end surface by a resilient connection.

In some aspects, the resilient connection is formed by a connecting portion extending between the end surface and the guide member, the connecting portion having a thickness that is less than a thickness of the guide member.

In some aspects, an outer surface of the guide member has a tapered profile.

In some aspects, the second portion includes a plurality of guide members positioned around the passageway.

In some aspects, each of the guide members is spaced apart from an adjacent guide member by a peripheral gap.

In another independent aspect, a connector for providing electrical communication between a plurality of conductors includes a block including a first opening for receiving a first conductor and a second opening for receiving a second conductor; and an alignment member positioned in the first opening of the block, the alignment member providing a passageway configured to receive one of the electrical conductors, the alignment member being adjustable relative to the block to modify a dimension of the passageway.

In some aspects, the alignment member includes a movable guide member and a threaded outer surface threadably engaging the first opening of the connector block, threading the alignment member into the first opening causing movement of the guide member.

In some aspects, the alignment member includes an annular portion having an end surface, wherein a guide member is resiliently supported on the end surface.

In some aspects, a connecting portion extends between the end surface and the guide member, and the connecting portion has a thickness that is less than a thickness of the associate guide member.

In some aspects, the alignment member includes a movable guide member and threading the alignment member into the first opening causes an outer surface of the guide member to engage a surface of the block, thereby biasing the guide member inwardly toward the passageway.

In some aspects, the alignment member includes a plurality of guide members positioned around the passageway.

In some aspects, each of the guide members is spaced apart from an adjacent guide member by a peripheral gap.

In yet another independent aspect, a method of connecting an electrical conductor to a connector block includes passing an end of the electrical conductor through a passageway of an alignment member and into a connector block; and, while the end of the electrical conductor is positioned in the connector block, adjusting the alignment member to modify a dimension of the passageway.

In some aspects, adjusting the alignment member includes moving the alignment member between a first state and a second state, in the first state at least one guide member of the alignment member is in an extended position, and in the second state the guide member is contracted to engage the conductor.

In some aspects, wherein adjusting the alignment member includes threading the alignment member relative to an opening of the connector block.

In some aspects, adjusting the alignment member includes moving guide members of the adjustment member, each guide member resiliently supported to allow the guide member to flex as the alignment member is adjusted.

In some aspects, adjusting the alignment member includes modifying a dimension of the passageway of the alignment member to be substantially equal to an outer diameter of the conductor.

In some aspects, adjusting the alignment member includes applying a torque to the alignment member by engaging the alignment member within a peripheral gap positioned between two adjacent guide members.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
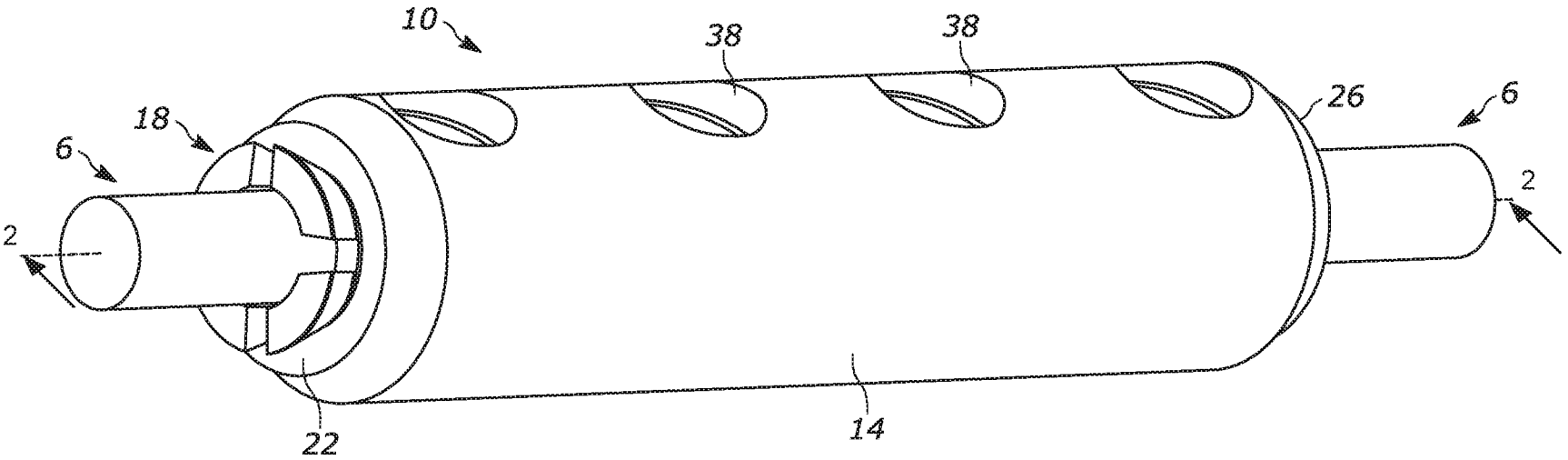
FIG. 1 is a perspective view of a connector block, a pair of conductors, and a pair of alignment members.
Figure 2:
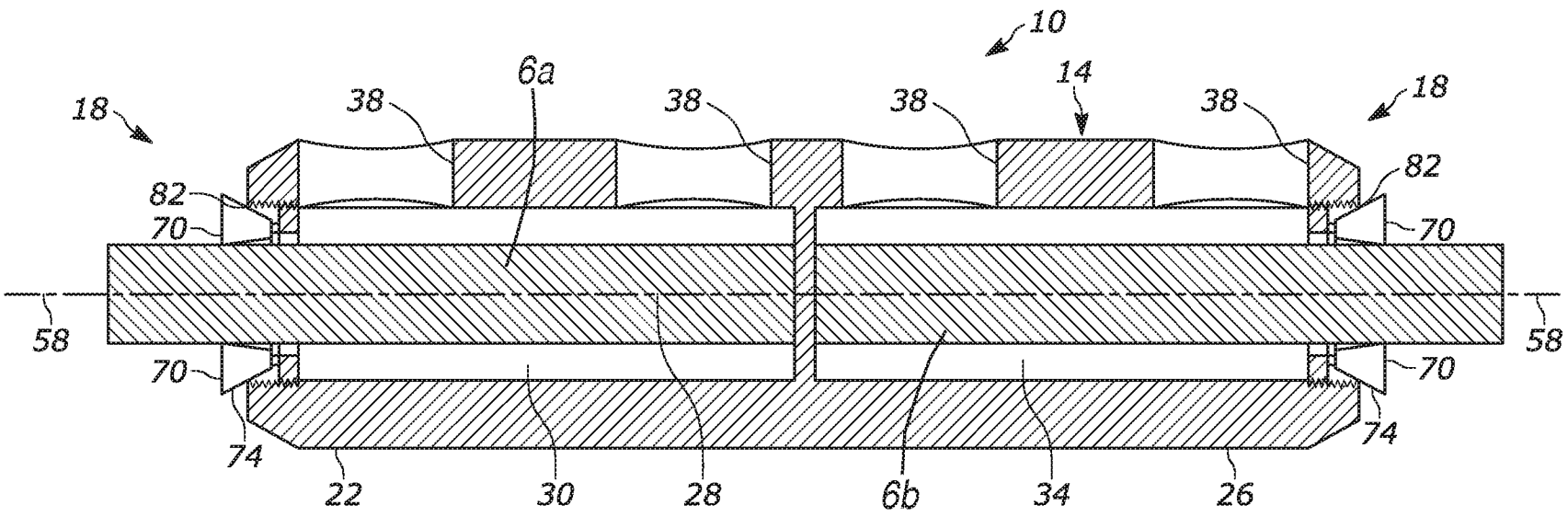
FIG. 2 is a section view of the connector block, conductors, and alignment members of FIG. 1 viewed along section 2-2.

FIGS. 1-4 illustrate a connector 10 for providing electrical connection between multiple electrical conductors 6. Referring to FIG. 1, the connector 10 includes a connector block 14 and centering members or alignment members 18. In the illustrated embodiment, the connector block 14 includes an elongated body having a first end 22 and a second end 26, and the body extends along a longitudinal axis 28 (FIG. 2).

As shown in FIG. 2, a first bore 30 is positioned adjacent the first end 22 and a second bore 34 is positioned adjacent the second end 26. In the illustrated embodiment, a partition is positioned between the first bore 30 and the second bore 34. A first conductor 6*a* can be positioned in the first bore 30, and a second conductor 6*b* can be positioned in the second bore 34. The connector block 14 includes multiple openings or holes 38 for receiving a fastener (not shown). In some embodiments, the holes 38 extend through an outer wall of the block 14 (e.g., radially with respect to the longitudinal axis 28 of the block 14) and are spaced apart along the length of the block 14. The holes 38 can be positioned such that adjacent holes 38 are aligned with one another in a direction parallel to the longitudinal axis 28 of the block 14 (see e.g., FIGS. 1-3), or may be positioned such that adjacent holes are circumferentially offset from one another (see e.g., FIG. 4). The holes 38 are illustrated with smooth inner surfaces, but it is understood that the holes 38 may be threaded. Fasteners can be inserted into the holes 38 to engage the conductors 6 in the first bore 30 and the second bore 34. The fasteners and the block 14 are electrically conductive to provide electrical communication between the conductors 6.

Figure 6:
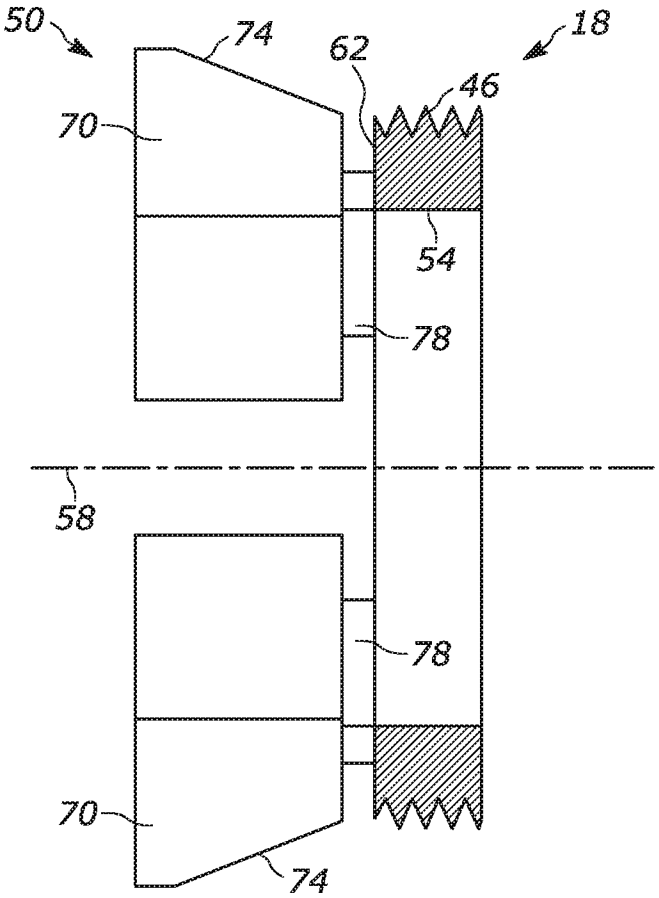
FIG. 6 is a section view of the alignment member of FIG. 5 viewed along section 6-6.
Figure 5:
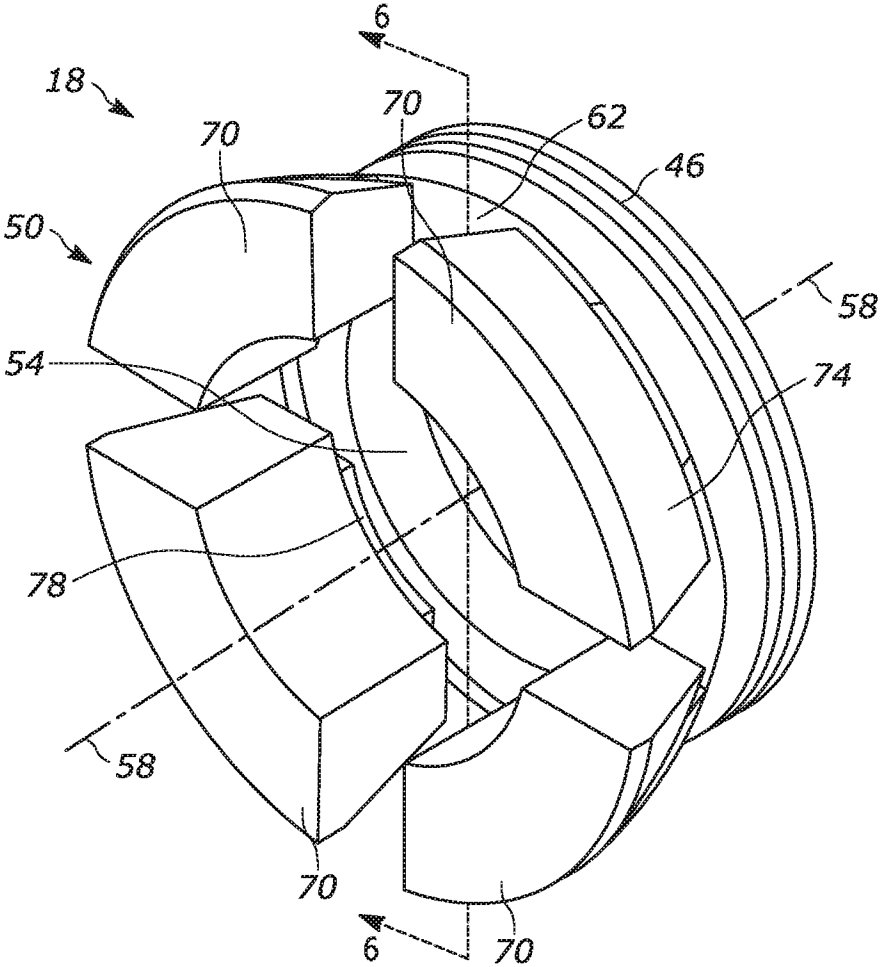
FIG. 5 is a perspective view of one of the alignment members of FIG. 1.

As shown in FIG. 2, two alignment members 18 are coupled to the connector 10. One alignment member 18 is positioned in the opening of the bore 30 adjacent the first end 22, and the other alignment member 18 is positioned in the opening of the bore 34 adjacent the second end 26 of the block 14. As shown in FIGS. 5 and 6, each alignment member 18 includes a first portion or threaded portion 46 and a second portion or centering portion 50. In addition, a bore 54 extends through the alignment member 18 along an axis 58. The threaded portion 46 includes a threaded surface for engaging threads in the openings at the first end 22 and the second end 26.

In the illustrated embodiment, the centering portion 50 is positioned proximate an end surface 62 of the threaded portion 46 and is positioned adjacent the threaded portion 46 in a direction parallel to the axis 58 of the bore 54. The centering portion 50 includes blades or guide members 70. In the illustrated embodiment, the centering portion 50 includes four guide members 70 that are spaced apart from one another about the axis 58 by 90 degrees, and each guide member 70 has a terminal surface having a quarter-circular shape. Arcuate spaces are positioned between the ends of adjacent guide members 70, forming gaps along a peripheral edge of the guide members 70. Also, the radial outer surfaces 74 of the guide members 70 are tapered (e.g., the outer surfaces of the guide members 70 have a frustoconical profile). In other embodiments, the alignment member can include fewer or more guide members, and/or the guide members may have different shapes or configurations.

As shown in FIG. 6, in the illustrated embodiment each guide member 70 is coupled to the threaded portion 46 by a connecting portion or bridge 78. In the illustrated embodiment, each bridge 78 extends between the end surface 62 of the threaded portion 46 and an associated one of the guide members 70, and each bridge 78 supports the associated guide member 70 relative to the end surface 62 in a cantilevered manner. Each bridge 78 provides a resilient connection that permits bending of the associated guide member 70 relative to the threaded portion 46. In the illustrated embodiment, each bridge 78 has a thickness (e.g., a dimension in a direction transverse to the axis 58 of the bore 54) that is less than a thickness of the guide member 70. The reduced thickness provides resilience to permit bending of the guide members 70.

Figure 3:
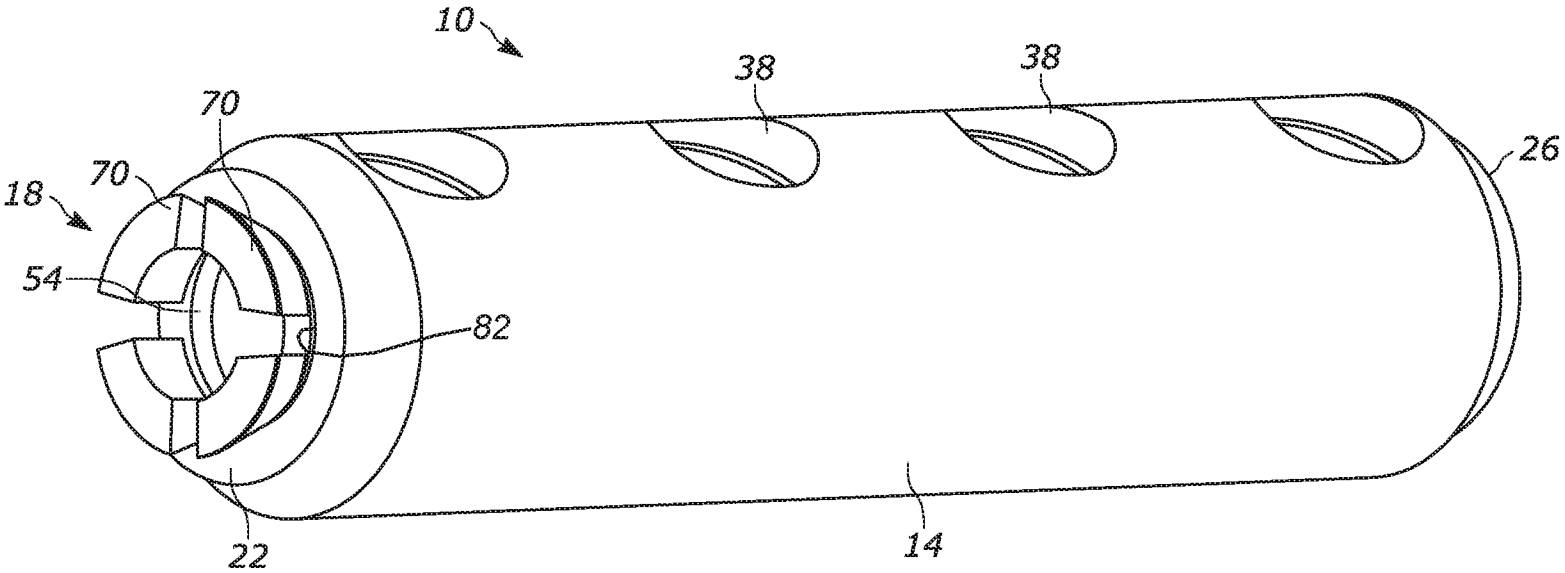
FIG. 3 is a perspective view of the connector block and alignment members of FIG. 1 with the alignment member in a first position.
Figure 4:
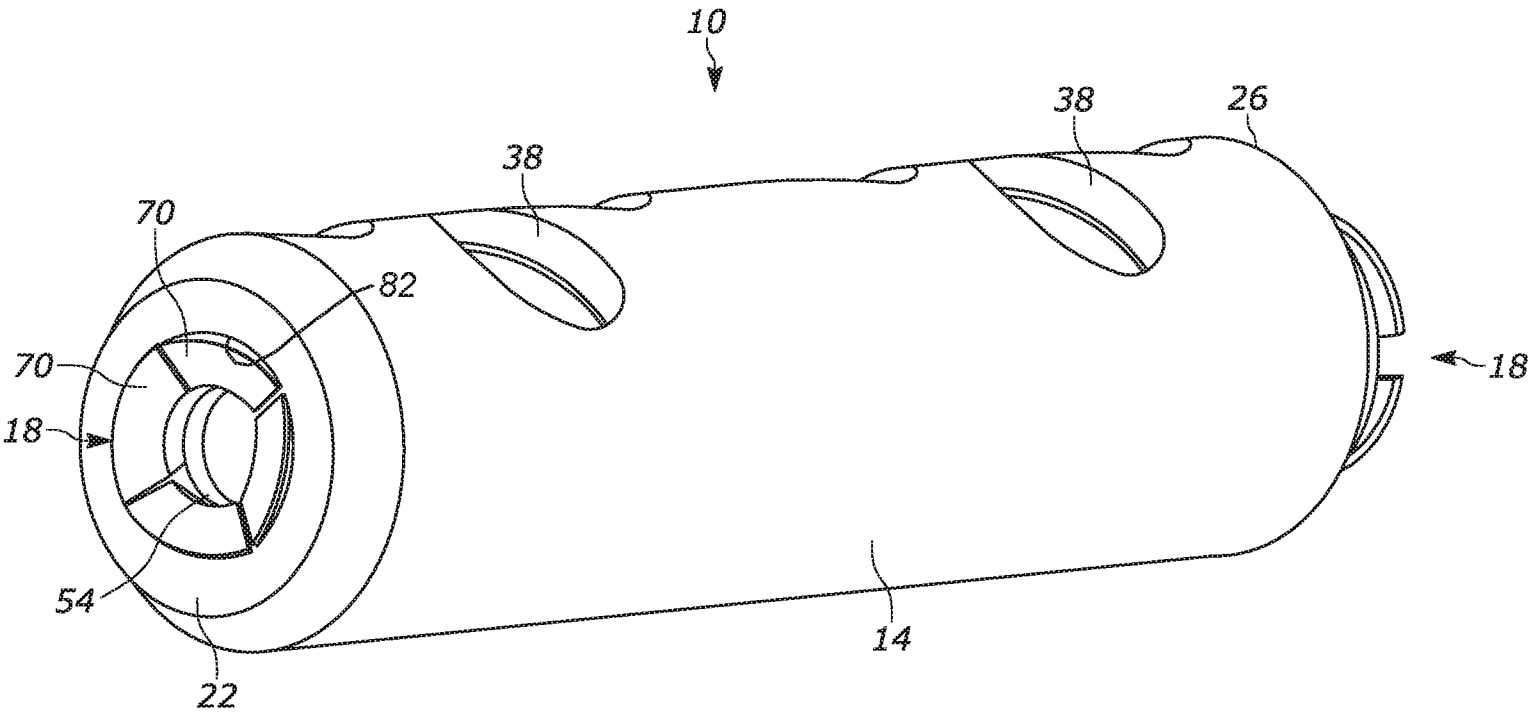
FIG. 4 is a perspective view of the connector block and alignment members of FIG. 1 with the alignment member in a second position.

Referring back to FIGS. 3 and 4, the threaded portion 46 is threaded into the opening at one end of the block 14. During a first stage of insertion, the guide members 70 are in an unbiased or extended position (FIG. 3). Stated another way, the portion of the bore 54 of the alignment member 18 surrounded by the guide members 70 is at its nominal distance. As the threaded portion 46 is threaded further into the opening a predetermined distance, the outer surfaces 74 of the guide members 70 contact an edge 82 of the block 14 adjacent the opening. In a second stage of insertion, the edge 82 biases the guide members 70 inwardly toward the axis 58 (FIG. 4). As the alignment member is threaded into the block, the dimension of the bore 54 decreases.

At an initial stage of assembly, the alignment member 18 is positioned adjacent the end of the connector block 14 and is in an unbiased state (i.e., the guide members 70 are extended). As shown in FIGS. 1 and 2, during installation, an operator inserts one of the conductors 6*a*, 6*b* through the alignment member 18 and into the connector block 14. The alignment member 18 is then threaded into the connector block 14 until the guide members 70 are biased inwardly and engage or contact the outer surface of the conductor 6 (FIG. 2), indicating that the conductor 6 is substantially centered within the connector block 14. In some embodiments, gaps or slots in the peripheral edge of the alignment member 18 permit a user to rotate the alignment member 18 easily.

The alignment member 18 maintains the conductor 6 on each side of the connector 10 in a centered position, facilitating a smooth transition between the connector block 14 and the conductor 6 and avoiding a bend in the conductor 6 or a non-symmetric condition that can create stress in the conductor and/or compromise the insulation. In addition, the alignment member 18 is adjustable to permit a user to modify an opening size by threading the alignment member 18 in the connector body, thereby accommodating a large range of conductor sizes and eliminating the need for multiple alignment members for specific conductor sizes.

The embodiments described above and illustrated in the figures are presented by way of example only and are not intended as a limitation upon the concepts and principles presented herein. As such, it will be appreciated that variations and modifications exist within the scope and spirit of one or more independent aspects as described.

The invention claimed is:

1. An alignment member for an electrical connector, the electrical connector configured to provide electrical communication between a plurality of electrical conductors, the alignment member comprising:

a first portion adapted to engage an opening of the connector block, the first portion being an annular portion having an end surface;

a passageway extending through the first portion and configured to receive one of the electrical conductors; and a second portion coupled to the first portion, the second portion being movable to adjust a dimension of the passageway, the second portion including a guide member supported on the end surface by a resilient connection, the resilient connection formed by a connecting portion extending between the end surface and the guide member, the connecting portion having a thickness that is less than a thickness of the guide member.

2. The alignment member of claim 1, wherein the first portion includes a threaded outer surface configured to threadably engage the opening of the connector block, threading the first portion into the opening of the connector block causing the second portion to move.

3. The alignment member of claim 1, wherein an outer surface of the guide member has a tapered profile.

4. The alignment member of claim 1, wherein the second portion includes a plurality of guide members positioned around the passageway.

5. The alignment member of claim 4, wherein each of the guide members is spaced apart from an adjacent guide member by a peripheral gap.

6. A connector for providing electrical communication between a plurality of conductors, the connector comprising:

a block including a first opening for receiving a first conductor and a second opening for receiving a second conductor; and an alignment member positioned in the first opening of the block, the alignment member including a first end, a second end, and a passageway extending between the first end and the second end, the passageway configured to receive the first conductor therethrough, the alignment member being adjustable relative to the block to modify a dimension of the passageway, the alignment member including an annular portion having an end surface, wherein a guide member is resiliently supported on the end surface, wherein a connecting portion extending between the end surface and the guide member, the connecting portion having a thickness that is less than a thickness of the associated guide member.

7. The connector of claim 6, wherein the alignment member includes a threaded outer surface threadably engaging the first opening of the connector block, threading the alignment member into the first opening causing movement of the guide member.

8. The connector of claim 6, wherein threading the alignment member into the first opening causes an outer surface of the guide member to engage a surface of the block, thereby biasing the guide member inwardly toward the passageway.

9. The connector of claim 6, wherein the alignment member includes a plurality of guide members positioned around the passageway.

10. The connector of claim 9, wherein each of the guide members is spaced apart from an adjacent guide member by a peripheral gap.

11. The connector of claim 6, wherein an outer surface of the guide member has a tapered profile.

12. A connector for providing electrical communication between a plurality of conductors, the connector comprising:

a block including a first opening for receiving a first conductor and a second opening for receiving a second conductor; and an alignment member positioned in the first opening of the block, the alignment member including a first end, a second end, and a passageway extending between the first end and the second end, the passageway configured to receive the first conductor therethrough, the alignment member being adjustable relative to the block to modify a dimension of the passageway, the alignment member including a movable guide member and a threaded outer surface threadably engaging the first opening of the connector block, threading the alignment member into the first opening causing movement of the guide member.

13. The connector of claim 12, wherein threading the alignment member into the first opening causes an outer surface of the guide member to engage a surface of the block, thereby biasing the guide member inwardly toward the passageway.

14. The connector of claim 12, wherein the alignment member includes an annular portion having an end surface, wherein the guide member is resiliently supported on the end surface.

15. The connector of claim 14, wherein a connecting portion extends between the end surface and the guide member, and the connecting portion has a thickness that is less than a thickness of the associated guide member.

16. The connector of claim 12, wherein the movable guide member is one of a plurality of guide members positioned around the passageway.

17. The connector of claim 16, wherein each of the guide members is spaced apart from an adjacent guide member by a peripheral gap.

18. The connector of claim 12, wherein an outer surface of the movable guide member has a tapered profile.

* * * * *